US005934469A

United States Patent [19]

Gould

[11] Patent Number: 5,934,469

[45] Date of Patent: Aug. 10, 1999

[54] PACKAGE WITH OVERLAY PANEL

[76] Inventor: Paul C. Gould, 40 Dewey Dr., Ringwood, N.J. 07456

[21] Appl. No.: 08/912,980

[22] Filed: Aug. 12, 1997

[51] Int. Cl.[6] ..... B65D 65/38

[52] U.S. Cl. ..... 206/457; 493/162

[58] Field of Search ..... 206/63.3, 232, 206/457; 229/116.1–116.5, 68.1, 128; 483/162

[56] References Cited

U.S. PATENT DOCUMENTS

| | | | |
|---|---|---|---|
| 359,435 | 3/1887 | Elliott . | |
| 2,964,227 | 12/1960 | Goldsholl | 229/21 |
| 3,010,571 | 11/1961 | Transport | 206/45.15 |
| 3,078,989 | 2/1963 | Curran et al. | 229/116.1 |
| 3,126,145 | 3/1964 | Struble | 229/128 |
| 3,343,743 | 9/1967 | Hamilton et al. | 229/21 |
| 3,637,130 | 1/1972 | Farquhar | 229/28 |
| 3,964,606 | 6/1976 | Hogg et al. | 206/395 |
| 4,032,005 | 6/1977 | Vereb | 206/45.14 |
| 4,887,709 | 12/1989 | Shimamine | 206/45.14 |
| 5,061,501 | 10/1991 | Lowe | 426/124 |

*Primary Examiner*—Jim Foster

*Attorney, Agent, or Firm*—Thomas L. Adams, Esq.

[57] ABSTRACT

A package containing an enclosed space of a predetermined width, includes an internal panel, and external panel and an overlay panel. The internal panel has a main section with an opposing pair of internal edges spaced by at least the predetermined width. A primary closure flap is hingedly connected to the main section along a curved fold line. This curved fold line is substantially transverse to the internal edges. The curved fold line is also bowed inwardly to impart to the primary closure flap a concavo-convex shape. The external panel is hingedly connected along a longitudinal fold line to one of the internal edges of the internal panel. The external panel is folded along the longitudinal fold line to a position alongside the internal panel. The internal and the external panels are on opposite sides of the enclosed space. The overlay panel is hingedly connected along an exterior fold line to the external panel. The overlay panel is folded to a position alongside the internal panel. The overlay panel and the external panel are on opposite sides of the enclosed space. The overlay panel is non-rectangular and is sized to present a facade with at least one dimension substantially greater than a corresponding dimension of the enclosed space.

33 Claims, 3 Drawing Sheets

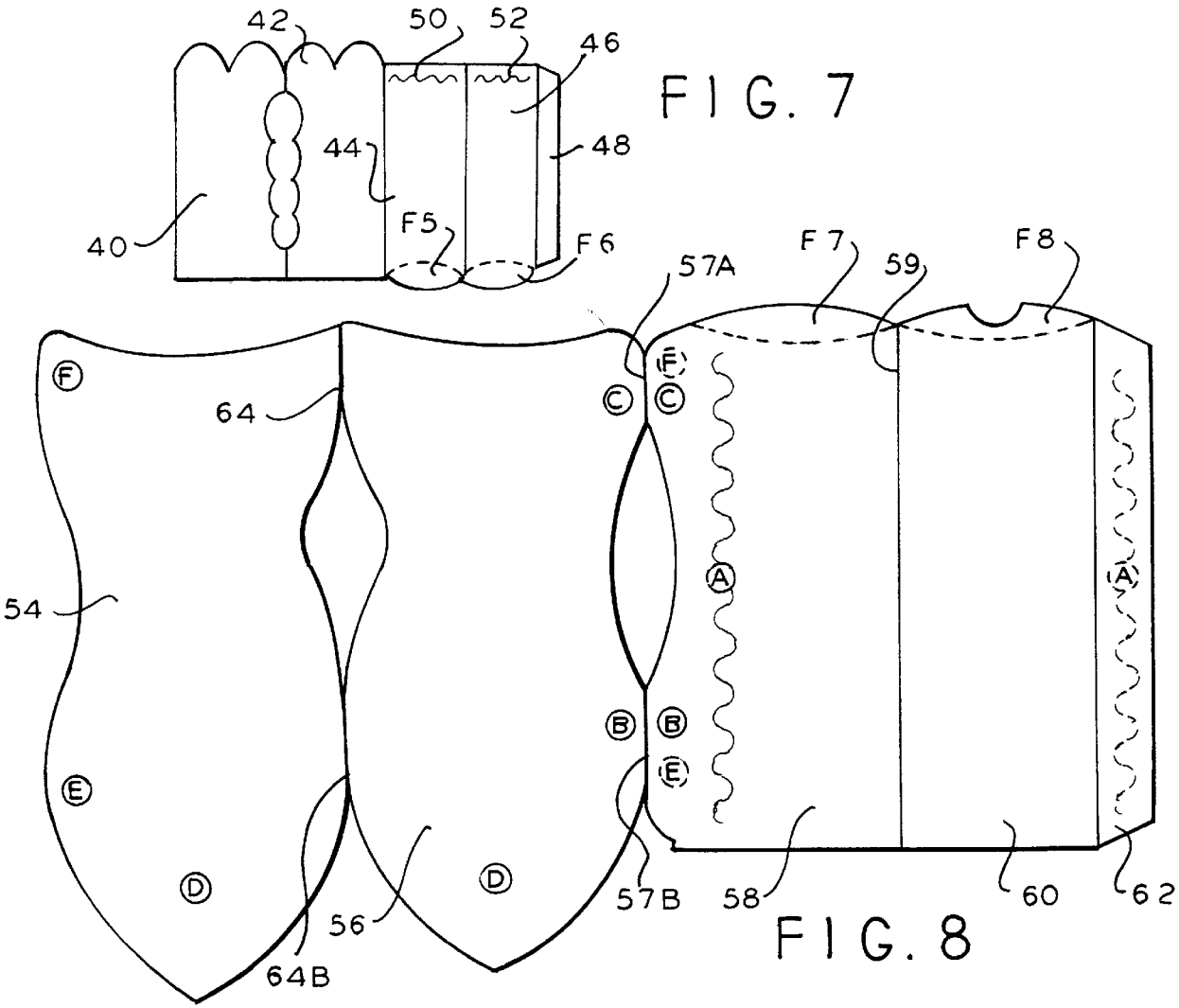
FIG. 7
FIG. 8
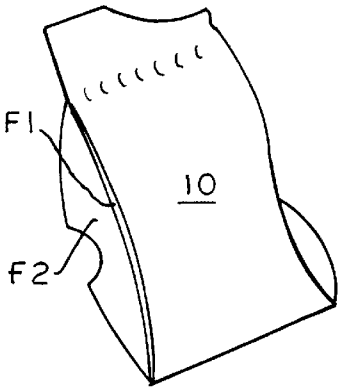
FIG. 5
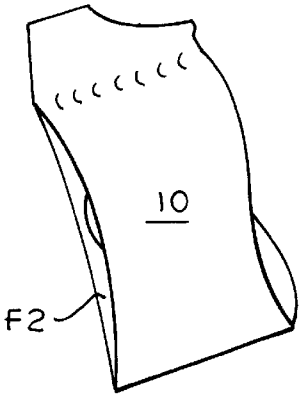
FIG. 6

PACKAGE WITH OVERLAY PANEL

BACKGROUND OF THE INVENTION

1. Field of the Invention

The present invention relates to packaging with a convex front and back and with a decoratively shaped periphery.

2. Description of Related Art

Packages distributed for promotional purposes ought to have a high visual impact. When the packages are delivered by hand or through the mail, the recipient will look at the package for only a short time before deciding whether to open or discard the item. Accordingly, an effective promotional package must have high visual impact to attract the recipient and arouse curiosity about the package contents. Also postal regulations and rates may favor packages having a certain thickness.

U.S. Pat. No. 3,343,743 shows a common package formed essentially of a pair of panels folded together to form an enclosure. The end flaps of the panels are scored to form closure flaps having a lenticular outline. When the package is closed, the outside of the two panels are convex while the flaps take a concavo-convex shape when closed. See also U.S. Pat. No. 359,435.

U.S. Pat. No. 3,964,606 shows a similar package with large hangtags extending from adjacent straight edges of the front and rear panels. These hangtags are sized and position in a way that limits the ability to change the outline and the visual impact of the package.

U.S. Pat. No. 4,887,709 shows another convex package with a hangtag projecting from a rounded edge of the back panel. Again, the hangtag is sized and positioned in a way that restricts the ability to greatly change the visual impact of the package.

U.S. Pat. No. 2,964,227 shows another convex package wherein one of the exposed panels is extended into a pleated section that can be tucked inside the package when closed. Because these additional pleats are inside the package, they are not visible and do not affect the visual impact of the package.

Other related packages are shown in U.S. Pat. Nos. 3,010,571; 3,637,130; 4,032,005; and 5,061,501.

Accordingly, there is need for a package that is arranged to have a shape that can be easily varied to present a high visual impact.

SUMMARY OF THE INVENTION

In accordance with the illustrative embodiments demonstrating features and advantages of the present invention, there is provided a package containing an enclosed space of a predetermined width. The package has an internal panel, an external panel, and an overlay panel. The internal panel has a main section with an opposing pair of internal edges spaced by at least the predetermined width. The internal panel also has a primary closure flap hingedly connected to the main section along a curved fold line. The curved fold line is substantially transverse to the internal edges. The curved fold line is also bowed inwardly to impart to the primary closure flap a concavo-convex shape. The external panel is hingedly connected along a longitudinal fold line to one of the internal edges of the internal panel. The external panel is folded along the longitudinal fold line to a position alongside the internal panel. The internal and the external panels are on opposite sides of the enclosed space. The overlay panel is hingedly connected along an exterior fold line to the external panel. The overlay panel is non-rectangular and is folded to a position alongside the internal panel. The overlay panel and the external panel are on opposite sides of the enclosed space.

According to another aspect of the invention a package blank for containing an enclosed space of a predetermined width, also has an internal panel, an external panel, and an overlay panel. The internal panel has a main section with an opposing pair of internal edges spaced by at least the predetermined width. The internal panel also has a primary closure flap hingedly connected to the main section along a curved fold line. The curved fold line is substantially transverse to the internal edges. The curved fold line is also bowed inwardly for imparting to the primary closure flap a concavo-convex shape. The external panel is hingedly connected along a longitudinal fold line to one of the internal edges of the internal panel. The external panel is adapted for folding along the longitudinal fold line to a position alongside the internal panel to place the internal and the external panels on opposite sides of the enclosed space. The overlay panel is hingedly connected along an exterior fold line to the external panel. The overlay panel is adapted for folding to a position alongside the internal panel. The overlay panel is also sized to present a facade with at least one dimension substantially greater than a corresponding dimension of the enclosed space. The overlay panel has an irregular periphery with portions more complex than either the curved or the longitudinal fold lines.

According to still another aspect of the present invention a packaging method is provided, employing a non-rectangular overlay panel and an internal panel hingedly connected on opposite sides of an external panel. This packaging method can contain an enclosed space of a predetermined width. The method includes the step of folding the internal panel to a position alongside the external panel to straddle the enclosed space. Another step is folding the overlay panel to a position alongside the internal panel, (A) to place the overlay panel and the external panel on opposite sides of the enclosed space, and (B) to position the overlay panel as a facade extending at least partially beyond the enclosed space. The method also includes the step of bending a portion of the internal panel along a curved fold line to a position substantially transverse to the external and the overlay panels. The curved fold line is bowed inwardly to impart to the primary closure flap a concavo-convex shape.

By employing packages and packaging methods of the foregoing type, an interesting appearance or a high visual impact can be achieved. In the preferred embodiments an overlay panel of an almost arbitrary outline can extend from an external panel that forms part of the structure of the package. The external panel may itself have an almost arbitrary outline that complements the outline of the overlay panel. When folded and assembled, the package can appear with this almost arbitrary outline.

In various embodiments, the package can employ one or more concavo-convex end flaps. In some embodiments the enclosed space of the package will between the external panel and an internal panel, with the overlay panel being primarily ornamental. In other embodiments the enclosed space of the package will be between the internal panel and an inside panel hingedly attached to the internal panel. The fold line between the overlay panel and the external panel (as well as between the external panel and the internal panel) may be a simple straight fold line, or an interrupted fold line (for example, two aligned folds separated by a gap).

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention, when taken in conjunction with the accompanying drawings, wherein:

FIG. 5 is an end view of a package of FIG. 4 with one of the flaps of FIG. 4 closed;

FIG. 6 is an end view of the package of FIG. 4 with both flaps of FIG. 4 closed;

FIG. 7 is developmental view of a package blank that is an alternate to that of FIG. 1;

FIG. 8 is developmental view of a package blank that is an alternate to that of FIG. 1;

DETAILED DESCRIPTION OF THE PREFERRED EMBODIMENTS

Figure 1:
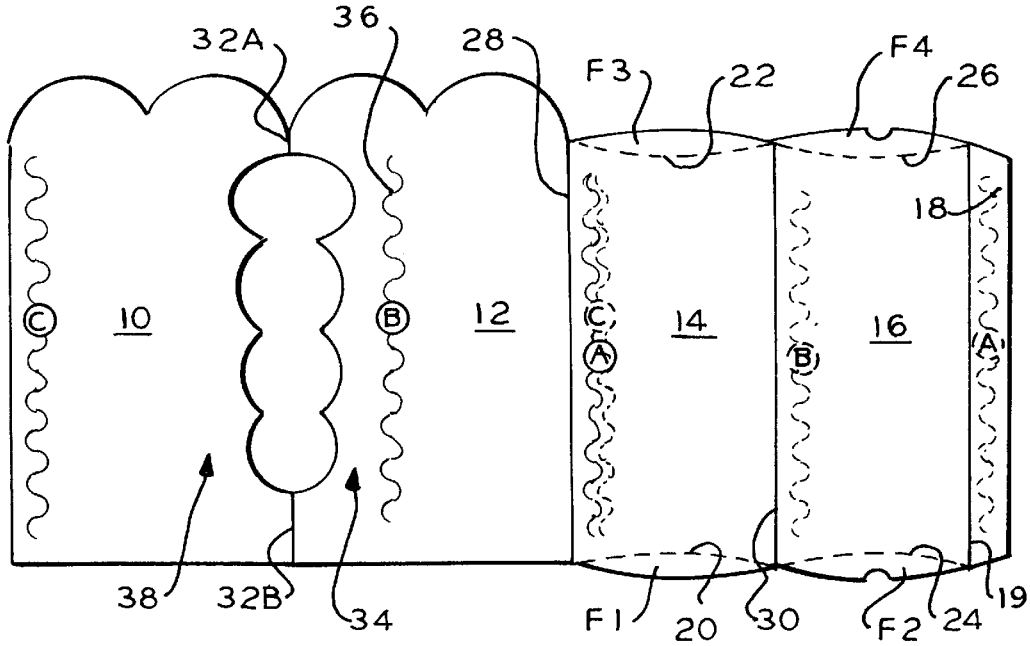
FIG. 1 is developmental view of a blank for forming a package in accordance with the principles of the present invention.

FIG. 1 shows a package blank that is die cut from a sheet material such as solid bleach sulfate folding board, although other types of materials can be used; for example, chipboard, heavy weight paper, sheet plastic etc. The blanks can formed by feeding a stack of individual sheets to a reciprocating die that can cut through the stack. Alternatively, a rotary die can cut package blanks from a web fed past the die.

These types of dies can have sharp ridges that mate with grooves on an opposing plate or cylinder. Alternatively, the cutting die can be opposed simply by an ungrooved plate or cylinder. Besides cutting with sharp ridges, the blank can be scored by rounded ridges that provide fold lines. Alternatively, the fold lines can be created by a ridge that has sharp sections alternating with dull sections, so that the fold line is perforated as well as scored. The latter type of operation is referred to as skip scoring. The dashed lines in FIG. 1 indicate skip scoring. The solid internal lines (that is, lines that do not constitute the outer periphery of the blank) represent score lines for folding. It will be appreciated however any fold line can be either scored or skipped scored, depending upon the requirements of the particular embodiment.

The blank of FIG. 1 is shown segregated into four main panels: overlay panel 10, external panel 12, internal panel 14 and inside panel 16. The internal panel 14 has at opposite ends an opposing pair of closure flaps, herein referred to as primary closure flap F1 and distal flap F3. The flaps F1 and F3 have a lenticular shape, although other shapes are contemplated such as linear segments. The primary closure flap F1 is integral with the main section of internal panel 14 and is separated by the skip scoring along curved fold line 20. Similarly, closure flap 3 is separated from the main section of internal panel 14 by the skip scoring along fold line 22.

Inside panel 16 has substantially the same length and width as internal panel 14. Internal panel 14 has a predetermined width defined as the dimension between internal edges 28 and 30. (Length refers to the longest, longitudinal dimension of the panel, while width is the dimension transverse thereto.) In this embodiment internal edge 28 also acts as a longitudinal fold line between panels 12 and 14. The inside panel 16 also has an opposite pair of closure flaps F2 and F4, joined by skip scoring to the main section of inside panel 16 by fold lines 24 and 26, respectively. The outside edges of flaps F2 and F4 are notched to provide finger holes for the purposes described presently. The rightmost edge (in this view) of inside panel 16 terminates with an attachment flap 18, designed to secure the panels together in a manner to be described presently.

External panel 12 is shown with an irregular border, which is essentially a mirror image of overlay panel 10. Therefore both of these irregular peripheries are considered complementary borders. The panels 10 and 12 are integrally joined by an exterior fold line, shown as interrupted fold line segments 30A and 30B. It will be noted that panels 10 and 12 have substantially greater area than panels 14 and 16. Specifically, panels 10 and 12 are longer and wider than panels 14 and 16.

As described presently, the package blank of FIG. 1 will be folded and held together by gluing. In this embodiment, adhesive is laid down in spots, strips or beads. For example in FIG. 1, a bead of adhesive will be laid along strip B (shown as a wavy line) on the face of panel 12 that is visible in this view (strip B is also referred to as the attachment region 36). This adhesive strip will attach to a mating strip B, which is on the reverse side of panel 16 and is therefore shown in phantom. It will be appreciated that the adhesive can be placed in either of the corresponding positions or both depending upon the desired holding strength tolerances etc.

Similarly, a strip A of adhesive laid on the illustrated side of panel 14 will mate with a strip A on the reverse side of attachment panel 18. Attachment panel 18 is integral connected to panel 16 along fold line 19. Also, the bead C of adhesive on the illustrated side of panel 10 will mate with the strip C on the reverse side of panel 14. Strips A and C are in registry on opposite sides of panel 14.

As will be explained presently, panels 14 and 16 will be folded together and then folded against panel 12. Because panel 12 is wider than panels 14 and 16, there will be an excess portion 34 (herein referred to as an ornamental portion) that exists beyond the attachment region 36. Being complementary, panel 10 also has a complementary ornamental section 38.

Figure 2:
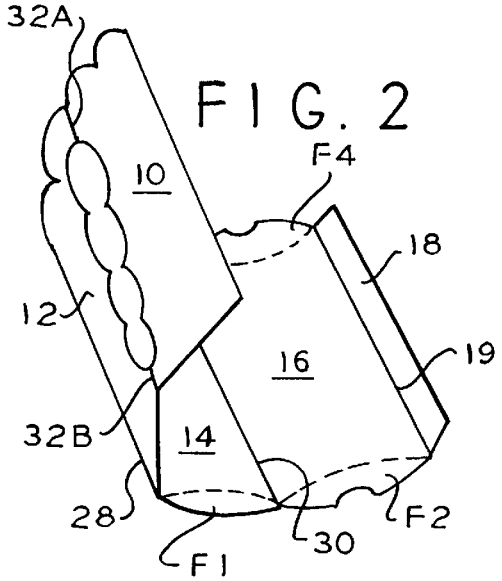
FIG. 2 shows the package blank of FIG. 1 in the process of being folded to form a package.
Figure 3:
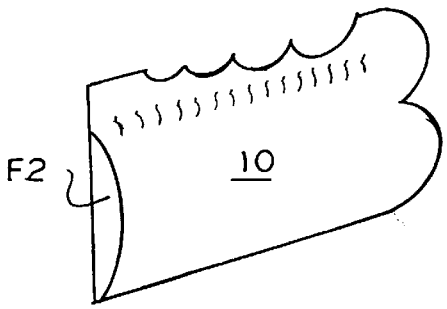
FIG. 3 shows a completed package formed from the blank of FIG. 1.

Referring now to FIGS. 1, 2 and 3, adhesive must be applied first to strips A, B and C (either one or both members of each mating pair) before assembly. Next, the attachment flap 18 is folded along line 19 to lie against the illustrated side of panel 16. Thereafter, inside panel 16 is folded along line to bring strip A of attachment flap 18 against strip A of internal panel 14, thereby gluing them together.

Next, panel 14 (together with panel 16 and flap 18) is folded along line 28. This brings together adhesive strips B on panels 16 and 12. Finally, overlay panel 16 is folded along lines 32A–32B to bring its adhesive strips C against the adhesive strip C on panel 14.

The assembly at this point is a flat package in which successive panels spiral inwardly. The panels that are touching are glued together except for the inside faces of panels 14 and 16, which embrace the previously mentioned enclosed space.

Figure 4:
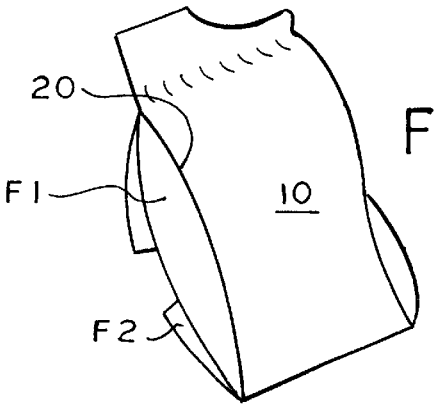
FIG. 4 is a detailed end view of the package of FIG. 3 with its two closure flaps open.

An object can be placed in the enclosed space between panels 14 and 16 by being inserted, for example, through the end bordered by closure flaps F1 and F2, as shown in FIG. 4. The object that can be inserted maybe a letter or a promotional sample, such as a perfume vial, detergent sample, or the like. After insertion into the enclosed space, the two ends of the package can be closed. As shown in FIG. 4, flaps F1 and F2 start parallel to the outside surfaces. The first flap F1 can be folded in along the curved fold line 20. Because fold line 20 is curved, flap F1 forms a concavo-convex shape as shown in FIG. 5.

Next, flap F2 can be folded up against flap F1. Being attached to the package also by a curved fold line (see FIG. 1) flap F2 forms the concavo-convex shape shown in FIG. 6. Flap F2 is shown with a finger notch, which facilitates opening of the subsequent opening of the package. The flap F2 can be held closed by means of transparent adhesive tape. It will be appreciated that the flaps at the opposite end at the package can be closed in a similar fashion.

Because the flaps at either end of the package have a lenticular shape, they bow the sides of the package as shown in FIG. 3.

The package shown in FIG. 3 has an irregular periphery that is substantially different than the periphery of the enclosed space inside the package. Because overlay panel 10 (and its complementary panel 12 on the reverse side) are larger than the package per se, the excess fringe area can be shaped in an arbitrary fashion.

Referring to FIG. 7, an alternate package blank is illustrated that is almost identical to FIG. 1. Specifically, panels 40, 42, 44, and 46 correspond to previously illustrated panels 10, 12, 14, and 16, respectively. Panels 44 and 46 have flaps F5 and F6 corresponding to flaps F1 and F2 of FIG. 1, as well as an attachment flap 48, corresponding to flap 18 of FIG. 1.

Panels 44 and 46 however, do not have closure flaps on the ends opposite flaps F5 and F6. Instead, these end portions are cut straight and adhesive strips 50 and 52 are placed adjacent the straight ends. The package is folded as before with the result that panels 44 and 46 are glued together along strips 50 and 52, opposite flaps F5 and F6. Consequently, the resulting package will be very similar to that shown in FIG. 3 except that the bowing will be predominantly at the end having flaps F5 and F6. The bowing will gradually decrease until reaching the ends having adhesive strips 50 and 52, where the package will have a thickness only that of the composite thicknesses of the material stacked at that end.

Referring to FIG. 8, a package blank is shown having an overlay panel 54, an external panel 56, a internal panel 58, an inside panel, 60 and an attachment flap 62, corresponding in most respects to items 10, 12, 14, 16, and 18, respectively, of FIG. 1. In this embodiment, internal panel 58 is wider than inside panel 60. Accordingly, the portion of panel 58 adjacent panel 56 will, upon folding, extend beyond panel 60 and can be cut for decorative purposes. Accordingly, the interrupted fold lines 57A and 57B between panels 56 and 58, are part of a curved outline that will be visually prominent after folding.

As before, adhesive strip A on the illustrated side of panel 58 will mate with adhesive strip A on the reverse side of attachment panel 62. Thus, flap 62 is folded up against the illustrated side of panel 60, before panel 60 is itself folded along fold line 59 against panel 58 to bring together adhesive strips A—A on items 58 and 62.

Next, panels 58 and 60 may be folded as a pair along interrupted longitudinal fold lines 57A and 57B against the illustrated side of panel 56 to bring the adhesive spots B—B and C—C on panels 56 and 58 together. Finally, overlay panel 54 can be folded along interrupted exterior fold lines 64A and 64B to bring the illustrated side of panel 54 against the reverse side of panel 58, thereby bringing together adhesive spots F—F and E—E. Also, the extended portions of panels of 54 and 56 will connect together by means of the adhesive spots D—D.

In this embodiment, the ends of panels 58 and 60 opposite flaps F7 and F8 are not glued together. Nevertheless, an article contained between these panels will not fall out because panels 54 and 56 will be linked across this otherwise open end and secured by means of adhesive spots D—D. Although this type of closure is not a tight seal, is adequate to retain a folded letter or similar article.

Once folded together in this fashion, flaps F7 and F8 can be closed in a manner similar to that described in connection with FIG. 1.

An important difference with the embodiment with FIG. 8 is the fact is that the panels 54 and 56 can extend past all four sides of the enclosed space formed between panels 58 and 60. In particular, panel 58 has an extended portion in the vicinity of fold lines 57A and 57B that can facilitate this feature. Thus, the regions at the interface between panels 58 and 56 contribute two ornamental regions that implement the decorative effect. Similarly, at the fold lines 64A and 64B, there is a ornamental region on panel 56 and an ornamental section on panel 54, implementing a decorative border.

Figure 9:
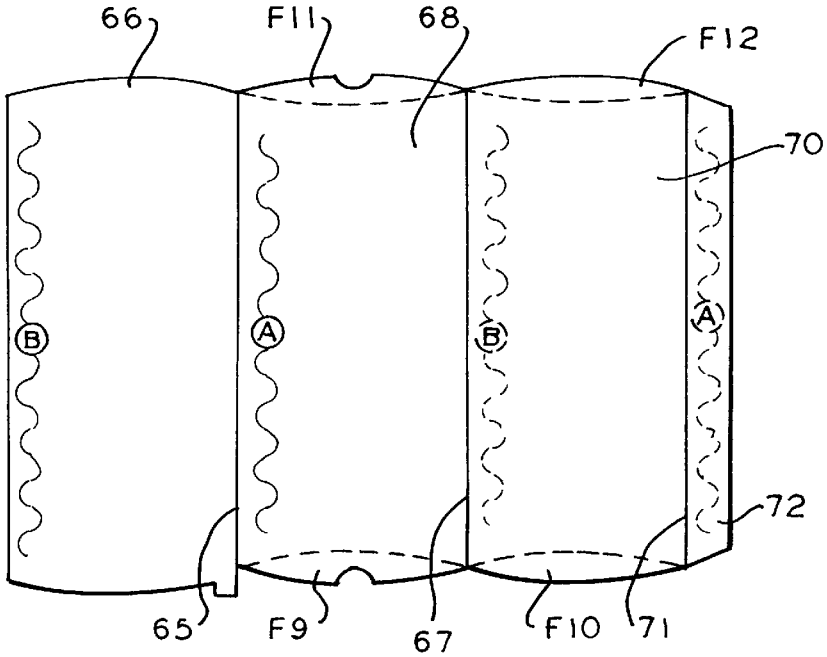
FIG. 9 is developmental view of a package blank that is an alternate to that of FIG. 1.

Referring to FIG. 9, an alternate package blank is shown, wherein only three panels are employed, which saves material costs. In this embodiment, panels 68 and 70 correspond essentially to panels 14 and 16 of FIG. 1, and have the same dimensions. Also, attachment flap 72 corresponds to flap 18 of FIG. 1. Panel 68 has closure flaps F9 and F11, while panel 70 has closure flaps F10 and F12, which are essentially the same as the closure flaps shown in FIG. 1 for the corresponding panels (except for the different placement of the illustrated finger notches).

Therefore, attachment flap 72 can be folded along fold line 71 and then brought into contact with panel 68 when panel 68 and 70 are folded together by folding along longitudinal fold line 67. At that time adhesive strip A on the reverse side of flap 72 attaches to the adhesive strip A on the illustrated side of panel 68. Consequently, panels 68 and 70 form another enclosed space. The fold line 67 between internal panel 70 and external panel 68 is a straight line.

When overlay panel 66 is folded along exterior fold line 65 against panel 70, the adhesive strips B—B attach. In this embodiment the overlay panel 66 has the same width as the other panels 68 and 70. In this embodiment the overlay panel 66 extends outwardly in the vicinity of the flaps F9 through F12 to present an outline simulating the shape of a cellular phone.

Figure 10:
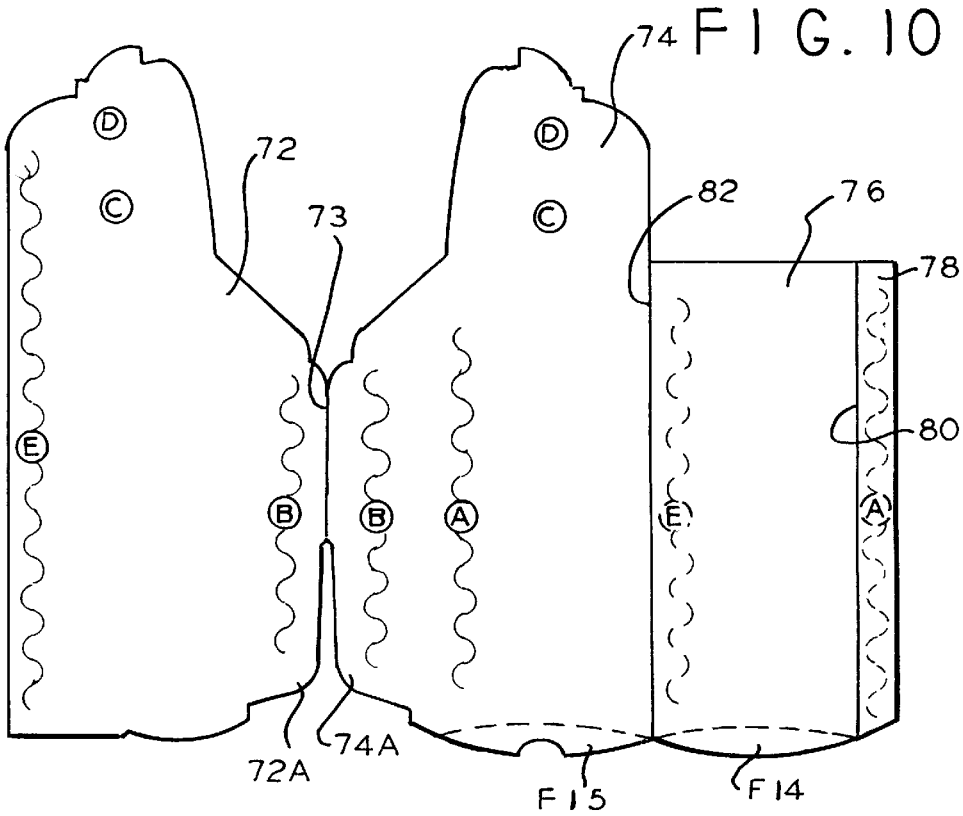
FIG. 10 is developmental view of a package blank that is an alternate to that of FIG. 1.

Referring to FIG. 10, an alternate package blank is shown with an internal panel 76 similar to panel 70 in FIG. 9, and with a closure flap F14, and an attachment flap 78 adjacent thereto, but with the end opposite flap F14 cut straight. Attachment flap 78 may be folded along line 80 up against the illustrated side of panel 76. Thereafter, panel 76 can be folded along longitudinal fold line 82 against the illustrated side of panel 74, so that the adhesive strips A—A join and form an enclosed space. Because panel 74 is wider than panel 76, there is an excess region 74A that may be act as an ornamental region.

Accordingly, panel 74 is shown with an irregular border in the vicinity of adhesive strip B and adhesive spots C and D. Similarly, overlay panel 72 has an ornamental section 72A in the vicinity of exterior fold line 73. Other than needing a common fold line with panel 74, the borders of panel 72 are not constrained and may have an arbitrarily decorative shape. Here, panel 72 is designed to have a border complementing that of panel 74.

When panel 72 is folded along line 73 against the reverse side of panel 76, adhesive strips E—E connect. Also, the portions of panels 74 and 72 extending beyond panel 76 each have adhesive spots C and D that connect together. As before, the adhesive spots on panel 74 and 72 close the enclosed space between panels 74 and 76 at the end opposite flaps F14 and F15. This closure is adequate to retain a folded letter or similar article. As before, an article can be inserted between flaps F14 and F15, which may then be folded inwardly to bow the panels 72, 74, 76 in the manner previously described.

It is appreciated that various modifications may be implemented with respect to the above described, preferred embodiment. For example, the various lengths and widths of the panels can be altered depending upon the article being packaged. In addition, the ornamental or decorative borders of the various panels can be changed depending on the desired appearance. Also, while the external and overlay panels are shown having complementary shapes, in some embodiments they may have different shapes and thus provide different projections at different locations. Furthermore, the outlines of the enclosure flaps can be varied, and in some embodiments may have a polygonal outline. Moreover, the above adhesive strips and spots for securing the panels, can be arranged in other ways. Also, instead of securing with an adhesive, the panels may be secured by adhesive tape, staples, rivets, snaps or other attachment devices. Additionally, while the panel blanks are shown cut from a single sheet, in some embodiments it may be desirable to piece separate panels together by gluing, taping or by other means.

Obviously, many modifications and variations of the present invention are possible in light of the above teachings. It is therefore to be understood that within the scope of the appended claims. The invention may be practiced otherwise than as specifically described.

I claim:

1. A package containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly to impart to said primary closure flap a concavo-convex shape;

an external panel hingedly connected along a longitudinal fold line to one of the internal edges of said internal panel, said external panel being folded along the longitudinal fold line to a position alongside said internal panel, the internal and the external panels being on opposite sides of said enclosed space;

an overlay panel hingedly connected along an exterior fold line to said external panel, said overlay panel being non-rectangular and being folded to a position alongside said internal panel, said overlay panel and said external panel being on opposite sides of said enclosed space, said external and said overlay panels each having at said exterior fold line an irregular border more complex than that of said enclosed space.

2. A package according to claim 1 wherein said overlay panel is sized to present a facade with at least one dimension substantially greater than a corresponding dimension of said enclosed space.

3. A package according to claim 1 wherein said primary closure flap is shaped to separate, deflect and outwardly bow said external and said overlay panels.

4. A package according to claim 1 wherein said internal panel is overlaid and said touched by said overlay panel.

5. A package according to claim 1 wherein said overlay panel has a greater surface area than said internal panel.

6. A package according to claim 5 wherein said overlay panel is longer than said internal panel.

7. A package according to claim 5 wherein said overlay panel is wider than said internal panel.

8. A package according to claim 1 wherein said internal panel has opposite said curved fold line a distal closure flap hingedly connected to said main section along a bowed fold line, said bowed fold line being bowed inwardly to impart to said distal closure flap a concavo-convex shape, said bowed fold line being substantially transverse to said internal edges.

9. A package containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly to impart to said primary closure flap a concavo-convex shape;

an external panel hingedly connected along a longitudinal fold line to one of the internal edges of said internal panel, said external panel being folded along the longitudinal fold line to a position alongside said internal panel, the internal and the external panels being on opposite sides of said enclosed space, said external panel having an attachment region attaching back to that one of said internal edges of said internal panel spaced furthest from said longitudinal fold line of said external panel, said external panel having an ornamental portion extending substantially beyond said attachment region in a direction away from said longitudinal fold line;

an overlay panel hingedly connected along an exterior fold line to said external panel, said overlay panel being non-rectangular and being folded to a position alongside said internal panel, said overlay panel and said external panel being on opposite sides of said enclosed space, said overlay panel having a greater surface area than said internal panel.

10. A package according to claim 9 wherein said overlay panel has an ornamental section contiguous to and coextensive with said ornamental section of said external panel.

11. A package according to claim 9 wherein said external panel has a greater surface area than said internal panel.

12. A package according to claim 11 wherein said external panel and said overlay panel each have a complementary border.

13. A package according to claim 9 wherein said longitudinal fold line is straight, uninterrupted and as long as the enclosed space.

14. A package containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly to impart to said primary closure flap a concavo-convex shape;

an external panel hingedly connected along a longitudinal fold line to one of the internal edges of said internal panel, said external panel being folded along the longitudinal fold line to a position alongside said internal panel, the internal and the external panels being on opposite sides of said enclosed space;

an overlay panel hingedly connected along an exterior fold line to said external panel, said overlay panel being non-rectangular and being folded to a position alongside said internal panel, said overlay panel and said external panel being on opposite sides of said enclosed space, said exterior fold line between said overlay panel and said external panel being interrupted.

15. A package containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly to impart to said primary closure flap a concavo-convex shape;

an external panel hingedly connected along a longitudinal fold line to one of the internal edges of said internal panel, said external panel being folded along the longitudinal fold line to a position alongside said internal panel, the internal and the external panels being on opposite sides of said enclosed space;

an overlay panel hingedly connected along an exterior fold line to said external panel, said overlay panel being non-rectangular and being folded to a position alongside said internal panel, said overlay panel and said external panel being on opposite sides of said enclosed space; and an inside panel hingedly connected to said main section of said internal panel and folded into a position between said internal and said external panels, said overlay and said external panels each having a greater surface area than said inside panel, said overlay and said external panels each having a greater surface area than said internal panel.

16. A package containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly to impart to said primary closure flap a concavo-convex shape;

an external panel hingedly connected along a longitudinal fold line to one of the internal edges of said internal panel, said external panel being folded along the longitudinal fold line to a position alongside said internal panel, the internal and the external panels being on opposite sides of said enclosed space;

an overlay panel hingedly connected along an exterior fold line to said external panel, said overlay panel being non-rectangular and being folded to a position alongside said internal panel, said overlay panel and said external panel being on opposite sides of said enclosed space; and an inside panel hingedly connected to said main section of said internal panel and folded into a position between said internal and said external panels, said overlay and said external panels each having a greater surface area than said inside panel.

17. A package containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly to impart to said primary closure flap a concavo-convex shape;

an external panel hingedly connected along a longitudinal fold line to one of the internal edges of said internal panel, said external panel being folded along the longitudinal fold line to a position alongside said internal panel, the internal and the external panels being on opposite sides of said enclosed space;

an overlay panel hingedly connected along an exterior fold line to said external panel, said overlay panel being non-rectangular and being folded to a position alongside said internal panel, said overlay panel and said external panel being on opposite sides of said enclosed space;

an inside panel hingedly connected to said main section of said internal panel and folded into a position between said internal and said external panels said overlay and said external panels each having a greater surface area than said inside panel, said overlay and said external panels each beingwider than said internal panel.

18. A package according to claim 1 wherein said exterior fold line between said overlay panel and said external panel is interrupted.

19. A package blank for containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly for imparting to said primary closure flap a concavo-convex shape;

an external panel hingedly connected along a longitudinal fold line to one of the internal edges of said internal panel, said external panel being adapted for folding along the longitudinal fold line to a position alongside said internal panel to place the internal and the external panels on opposite sides of said enclosed space; and an overlay panel hingedly connected along an exterior fold line to said external panel, said overlay panel being adapted for folding to a position alongside said internal panel, said overlay panel being sized to present a facade with at least one dimension substantially greater than a corresponding dimension of said enclosed space, said overlay panel having an irregular periphery with portions more complex than said longitudinal fold line, said exterior fold line between said overlay panel and said external panel being interrupted.

20. A package blank according to claim 19 wherein said external and said overlay panels each have at said exterior fold line an irregular border with portions more complex than either said curved or said longitudinal fold line.

21. A package blank according to claim 19 wherein said overlay panel has a greater surface area than said internal panel.

22. A package blank according to claim 19 wherein said overlay panel is wider than said internal panel.

23. A package blank according to claim 19 wherein said external panel has a greater surface area than said internal panel.

24. A package blank according to claim 23 wherein said external panel and said overlay panel each have an irregular, complementary border.

25. A package blank for containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly for imparting to said primary closure flap a concavo-convex shape;

an external panel hingedly connected along a longitudinal fold line to one of the internal edges of said internal panel, said external panel being adapted for folding along the longitudinal fold line to a position alongside said internal panel to place the internal and the external panels on opposite sides of said enclosed space;

an overlay panel hingedly connected along an exterior fold line to said external panel, said overlay panel being adapted for folding to a position alongside said internal panel, said overlay panel being sized to present a facade with at least one dimension substantially greater than a corresponding dimension of said enclosed space, said overlay panel having an irregular periphery with portions more complex than said longitudinal fold line; and an inside panel hingedly connected to said main section of said internal panel opposite said external panel, said inside panel being adapted for folding into a position between said internal and said external panels, said overlay and said external panels each having a greater surface area than said inside panel.

26. A package blank according to claim 25 wherein said overlay and said external panels each have a greater surface area than said internal panel.

27. A package blank according to claim 25 wherein said overlay and said external panels are each wider than said internal panel.

28. A package blank according to claim 25 wherein said exterior fold line between said overlay panel and said external panel is interrupted.

29. A package blank for containing an enclosed space of a predetermined width, comprising:

an internal panel having a main section with an opposing pair of internal edges spaced by at least said predetermined width, and a primary closure flap hingedly connected to said main section along a curved fold line, said curved fold line being substantially transverse to said internal edges, said curved fold line being bowed inwardly for imparting to said primary closure flap a concavo-convex shape;

an external panel hingedly connected along a longitudinal fold line to one of the internal edges of said internal panel, said external panel being adapted for folding along the longitudinal fold line to a position alongside said internal panel to place the internal and the external panels on opposite sides of said enclosed space;

an overlay panel hingedly connected along an exterior fold line to said external panel, said overlay panel being adapted for folding to a position alongside said internal panel, said overlay panel being sized to present a facade with at least one dimension substantially greater than a corresponding dimension of said enclosed space, said overlay panel having an irregular periphery with portions more complex than said longitudinal fold line; and an inside panel hingedly connected to said main section of said internal panel opposite said external panel, said inside panel being adapted for folding into a position between said internal and said external panels, said overlay, said external and said internal panels each being wider than said inside panel.

30. A packaging method employing a non-rectangular overlay panel and an internal panel hingedly connected on opposite sides of an external panel, for containing an enclosed space of a predetermined width, comprising the steps of:

folding said internal panel to a position alongside said external panel to straddle said enclosed space;

folding said overlay panel to a position alongside said internal panel, (A) to place said overlay panel and said external panel on opposite sides of said enclosed space, (B) to position said overlay panel as a facade extending at least partially beyond said enclosed space, and (C) to only partially overlap said external panel with said internal panel; and bending a portion of said internal panel along a curved fold line to a position substantially transverse to said external and said overlay panels, said curved fold line being bowed inwardly to impart to said primary closure flap a concavo-convex shape.

31. A packaging method according to claim 30 wherein the step of bending a portion of said internal panel is performed to separate, deflect and outwardly bow said external and said overlay panels.

32. A packaging method according to claim 30 wherein the step of folding said overlay panel is performed to cause it to touch and overlay said internal panel.

33. A packaging method according to claim 30 wherein an inside panel is hingedly attached to said internal panel, comprising the step of:

initially folding the inside panel next to said internal panel before folding said external panel.

* * * * *